US005297489A

United States Patent [19]

Schneider et al.

[11] Patent Number: 5,297,489

[45] Date of Patent: Mar. 29, 1994

[54] APPARATUS FOR CLAMPING AND PLACEMENT OF A DOCTOR BLADE BAR AGAINST AN INK-DISPENSING ROLLER

[75] Inventors: Georg Schneider, Würzburg; Wolfgang O. Reder, Veitshöchheim; Dieter Reinhart, Hettstadt, all of Fed. Rep. of Germany

[73] Assignee: Koenig & Bauer Aktiengesellschaft, Wurzburg, Fed. Rep. of Germany

[21] Appl. No.: 51,940

[22] Filed: Apr. 26, 1993

[30] Foreign Application Priority Data

Apr. 25, 1992 [DE] Fed. Rep. of Germany ..... 4213670

[51] Int. Cl.[5] ..... B41F 31/04; B41L 27/06

[52] U.S. Cl. ..... 101/350; 101/169

[58] Field of Search ..... 101/350, 363, 365, 366, 101/207, 208, 209, 210, 148, 157, 169, 425, 349; 118/261

[56] References Cited

U.S. PATENT DOCUMENTS

| | | | |
|---|---|---|---|
| 3,566,787 | 3/1971 | Moos | 101/363 |
| 3,601,051 | 8/1971 | Gegenheimer et al. | 101/169 X |
| 4,155,303 | 5/1979 | Johnston | 101/365 X |
| 4,964,336 | 10/1990 | Bock et al. | 101/157 X |

FOREIGN PATENT DOCUMENTS

| | | |
|---|---|---|
| 3832160 | 9/1988 | Fed. Rep. of Germany . |
| 3832216 | 9/1988 | Fed. Rep. of Germany . |

*Primary Examiner*—J. Reed Fisher

*Attorney, Agent, or Firm*—Jones, Tullar & Cooper

[57] ABSTRACT

An apparatus for the clamping and placement of a doctor blade bar against an ink-dispensing roller utilizes spaced lifting or camming strips on doctor blade base support beams and cooperating counter strips or cam followers on doctor blade supporting base bodies to support the doctor blade bar as it is moved toward or away from the screen roller. Doctor blade base shifting devices use rotatable clamping bodies which can be turned to form extensions of the base support beams on which the doctor blade bar can rest when it is in a mounting position.

9 Claims, 6 Drawing Sheets

APPARATUS FOR CLAMPING AND PLACEMENT OF A DOCTOR BLADE BAR AGAINST AN INK-DISPENSING ROLLER

FIELD OF THE INVENTION

The present invention is directed generally to an apparatus for the clamping and placement of a doctor blade bar against an ink dispensing roller. More particularly, the present invention is directed to an apparatus for clamping and placement of a doctor blade bar against an ink dispensing roller of a web-fed rotary printing press. Most specifically, the present invention is directed to an apparatus for clamping and placement of a doctor blade bar against an ink dispensing roller, such as a screen roller, of a web-fed rotary printing press. The apparatus of the present invention is usable to bring spaced, resiliently supported doctor blades of a short inking unit into contact with the surface of a screened ink roller or similar other roller in the printing press. Doctor blade base bodies, which form a part of the doctor blade bar, are supported on support beams and are shiftable by shifting devices between mounting, rest, and working positions.

DESCRIPTION OF THE PRIOR ART

Short inking units for use in web-fed rotary printing presses are generally known in the prior art. In these short inking units, it is conventional to utilize two spaced, axially extending doctor blades, in conjunction with spaced end plates, to form an ink receptacle or chamber. Ink is placed in this chamber and free ends of the doctor blades are brought into contact with the surface of an ink roller, which is frequently a screened surface ink roller. In such short inking units it is typically necessary to be able to bring the doctor blades into and out of contact with the surface of the screened ink roller and to be able to adjust the position of the doctor blades as well as to replace them when they become excessively worn.

In various prior art devices which are used to clamp and to place the chambered ink fountain and doctor blade assembly in its operative position with respect to a screened ink roller, there is required a technically complex mounting and assembly. Such a complex assembly is apt to be expensive, unreliable, and not easily or readily operable. Thus the prior art devices for the placement of doctor blades and their supports in place require a considerable technical outlay.

It will thus be seen that a need exists for an apparatus or device for clamping and placement of a doctor blade bar against an ink dispensing roller of a web-fed rotary printing press. The present invention provides such a device and is a significant advance over the prior art devices.

SUMMARY OF THE INVENTION

It is an object of the present invention to provide an apparatus for the clamping and placement of a doctor blade bar against an ink dispensing roller.

Another object of the present invention is to provide an apparatus for the clamping and placement of a doctor blade bar against an ink dispensing roller in a web-fed rotary printing press.

A further object of the present invention is to provide an apparatus for the clamping and placement of a doctor blade bar against an ink dispensing roller, such as a screen roller, in a web-fed rotary printing press.

Yet another object of the present invention is to provide a device for the clamping and placement of a doctor blade bar against an ink dispensing roller of a web-fed rotary printing press which is easy to manipulate.

Even a further object of the present invention is to provide a device for the clamping and placement of a doctor blade bar against an ink dispensing roller in which the doctor blade bar can be easily attached and placed against the ink-dispensing roller by simple means.

As will be discussed in greater detail in the description of the preferred embodiment which is set forth subsequently, the device for the clamping and placement of a doctor blade bar against an ink dispensing roller of a web-fed rotary printing press in accordance with the present invention utilizes doctor blade supporting base bodies which are slidably supported by doctor blade base support beams. These doctor blade base support beams also carry doctor blade base shifting devices which are actuable to move the base bodies to effect movement of the doctor blades into and out of contact with the screened ink roller. This movement of the base bodies by the base shifting devices is in a direction which moves the doctor blades toward and away from the screened ink roller in a direction which is generally in the plane of the blades so that the blades engage the screened ink roller at a negative angle. The doctor blades themselves may be resiliently supported in the base bodies. The doctor blade base support beams each carry two spaced lifting or camming strips which preferably have different camming slopes or gradients. The base bodies have cooperatively spaced counterstrips or cam followers which serve to move the doctor blades toward or away from the screen surface ink roller as the base bodies are slid generally horizontally on the doctor blade base support beams.

The doctor blade base support beams and their associated doctor blade base shifting devices are positionable to create a generally horizontal support surface or guide surface on which the doctor blade supporting base bodies will be supported in the course of throw-off of the chambered doctor blades or of the doctor blade base bodies from the screen roller. Ball handles of the shifting devices act as stops for limiting the horizontal travel of the base bodies on the support beams and guide surfaces. These ball handles are at the ends of levers which extend in a paraxial direction in respect to the doctor blade bar mounts. Little space for the manipulation of the doctor blade supporting base bodies is required in the printing press. The doctor blade supporting base bodies are slid along the support beams and are locked in place by operation of the doctor blade base shifting devices in one operational step by manipulation of the locking and placement portion of the present invention. This allows quick, efficient doctor blade bar placement and securement in a time-efficient, expeditious manner.

It will be seen that the apparatus for the clamping and placement of a doctor blade bar against an ink dispensing roller of a web-fed rotary printing press in accordance with the present invention overcomes the limitations of the prior art devices and is a substantial advance in the art.

BRIEF DESCRIPTION OF THE DRAWINGS

While the novel features of the device for the clamping and placement of a doctor blade bar against an ink dispensing roller of a web-fed rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
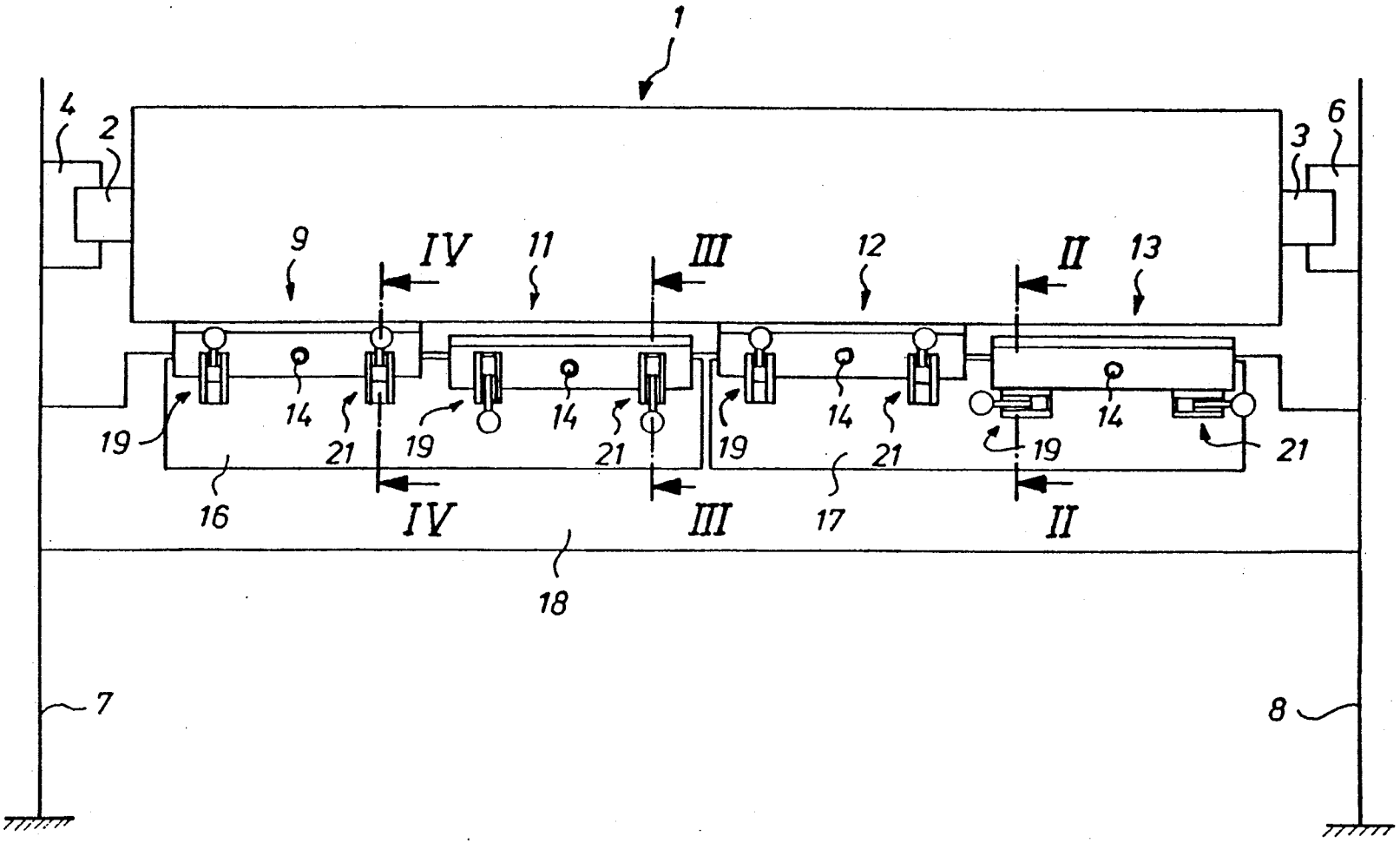
FIG. 1 is a front elevation view of a screen roller provided with four chambered doctor blades bars supported by the device in accordance with the present invention and showing the doctor blade bars disposed in several different positions.

Referring initially primarily to FIG. 1, there may be seen a preferred embodiment of a device for clamping and placement of doctor blade bars against an ink dispensing roller of a web-fed rotary printing press in accordance with the present invention. As may be seen in FIG. 1, there is provided an ink dispensing roller which is preferably in the form of a screen roller generally at 1. This screen roller 1 is rotatably supported between spaced side frames 7 and 8 by suitable axle journals 2 and 3. These axle journals 2 and 3 are supported in suitable cooperating bearings 4 and 6 that are secured on the side frames 7 and 8.

Figure 2:
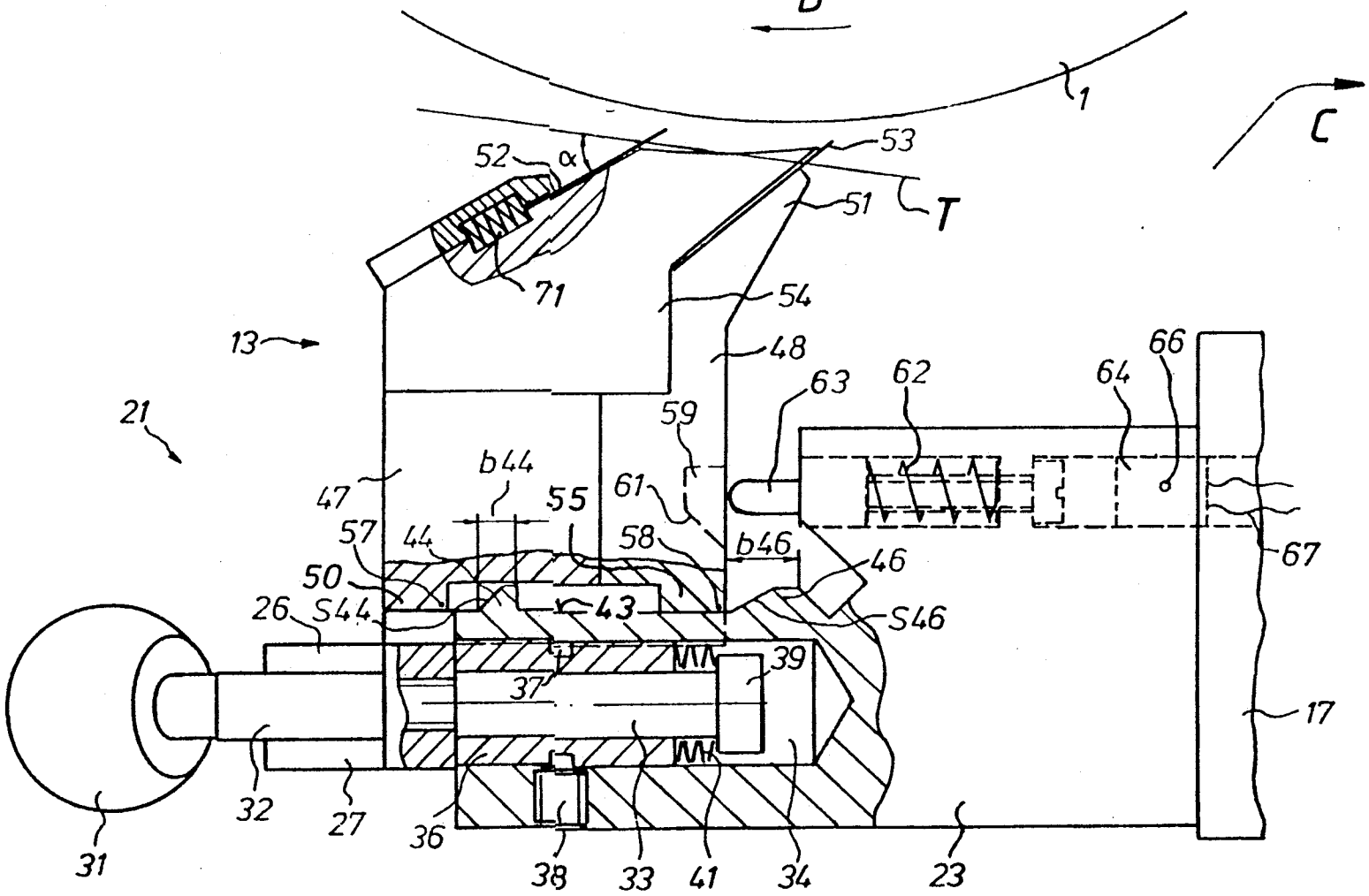
FIG. 2 is a side elevation view, partly in cross-section and taken along line II—II of FIG. 1 and showing a doctor blade bar assembly in a mounting position.
Figure 3:
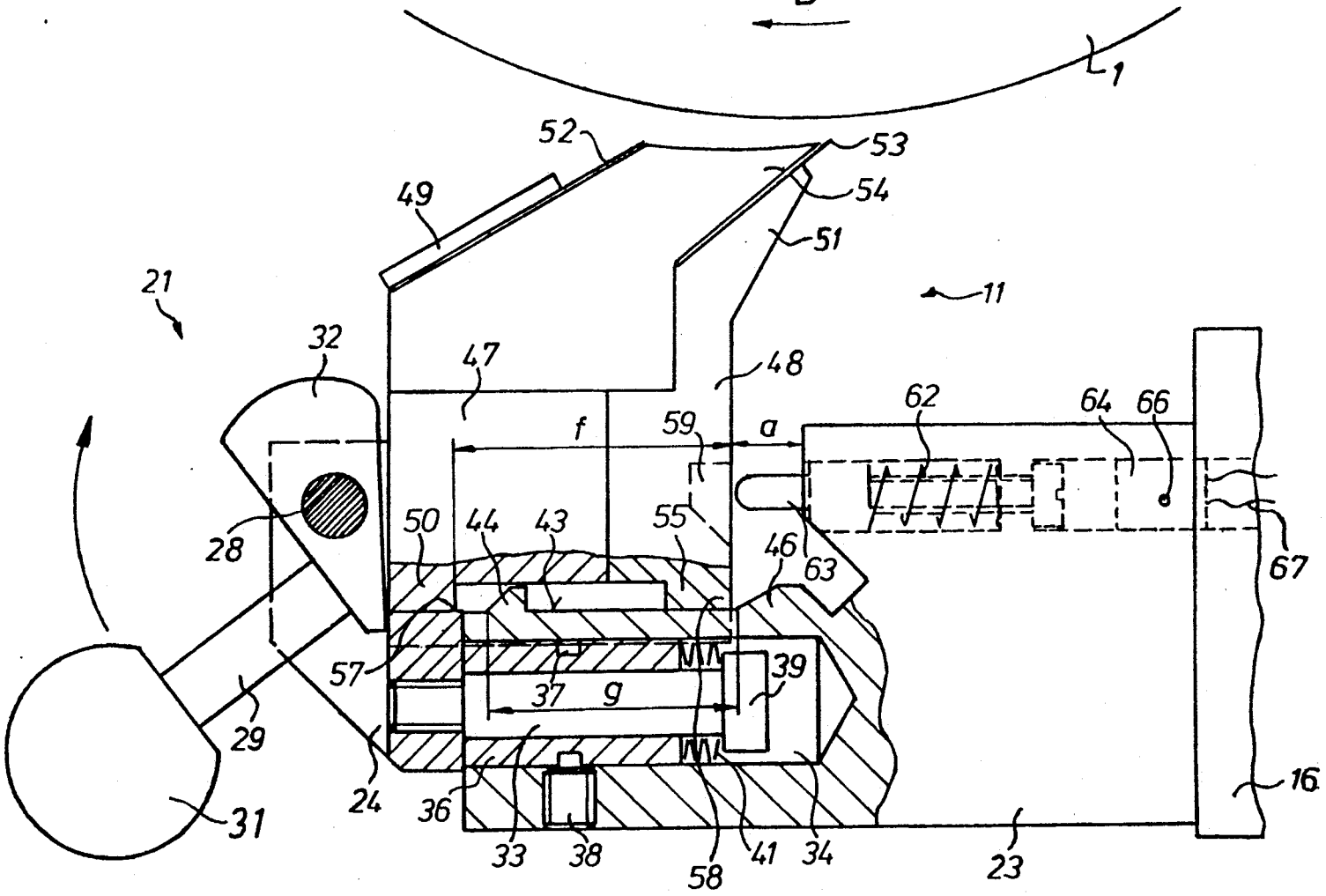
FIG. 3 is a side elevation view, partly in cross-section, taken along line III—III of FIG. 1 and showing a doctor blade bar assembly in a rest position.
Figure 4:
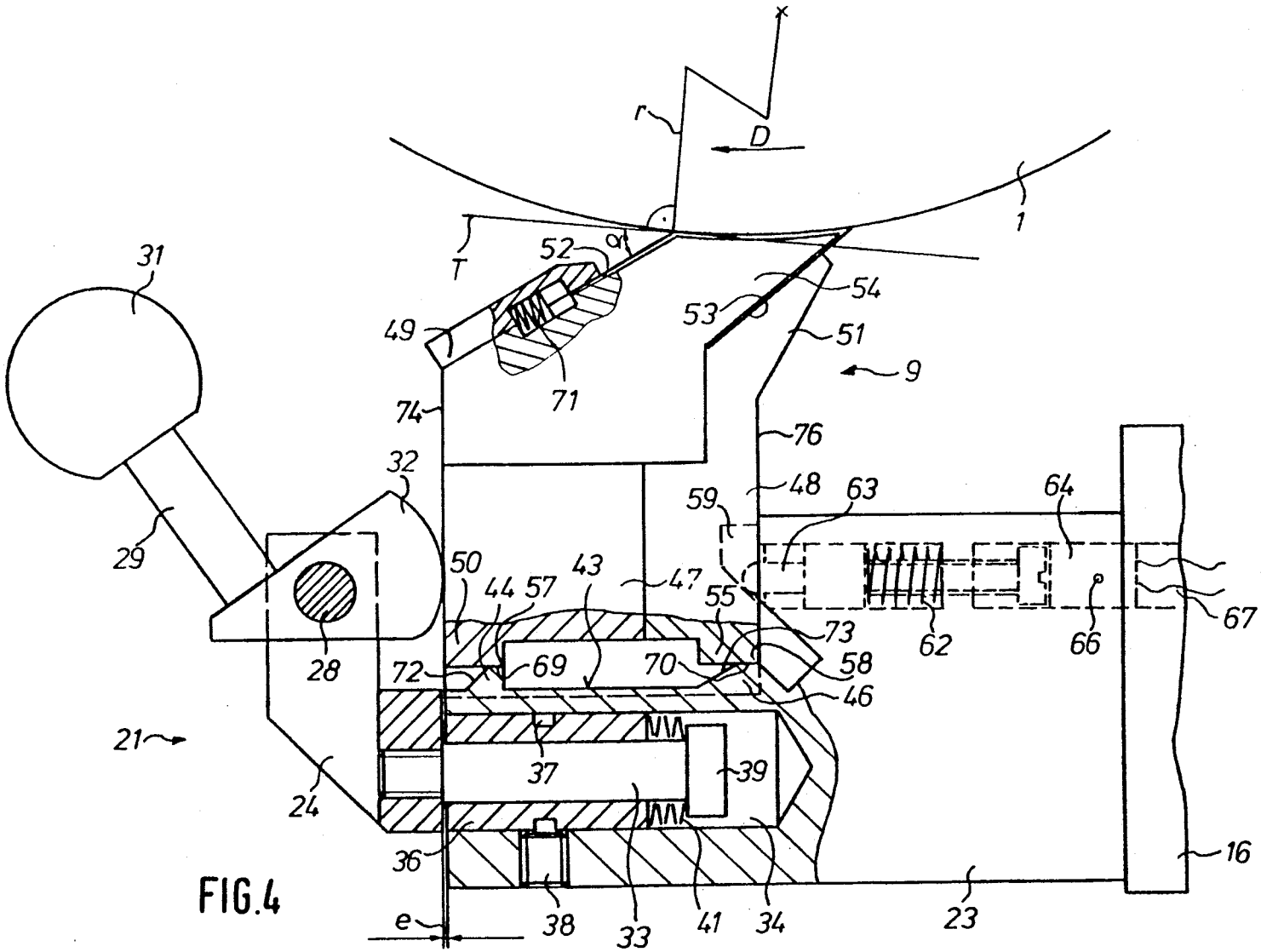
FIG. 4 is a side elevation view, partly in cross-section, taken along line IV—IV of FIG. 1, and showing a doctor blade bar assembly in a working position.

Four spaced, chambered doctor blade bars and their associated devices for use in placement of them against the screen roller 1 are shown generally at 9, 11, 12 and 13 in FIG. 1. These four doctor blade bars are located adjacent each other axially along the length of the screen roller 1 and are positioned generally beneath the screen roller 1, as shown in FIGS. 2, 3, and 4. In the depiction of the device in accordance with the present invention, as shown in FIG. 1, various ones of the doctor blade bars are shown in different positions. The doctor blade bar 13 is shown beneath the screen roller in its mounting position. The doctor blade bars 9 and 12 are shown in their working positions, and the doctor blade bar 11 is shown in its rest position. It will be understood that each of these doctor blade bars is positionable in each of its three positions; mounting, working or resting and that the depiction of specific ones of these doctor blade bars in certain positions is for purposes of illustration only.

Each of the doctor blade bars 9, 11, 12 and 13 is provided with an ink supply connection 14 which is connected by a suitable flexible line that is not specifically shown, to an ink pump. The ink pumps for the four axially spaced doctor blade bars 9, 11, 12 and 13 are also not specifically shown in the drawings. Each doctor blade bar 9, 11, 12 and 13 is also provided with an ink reservoir which, again, is not specifically shown. Each such ink reservoir can be formed in a generally funnel shape and can be placed beneath its associated doctor blade bar. In this way, each ink reservoir will be usable as a catch reservoir for the ink which is removed from the screened ink roller 1 by the associated doctor blade assembly.

The two adjacent doctor blade bars 9 and 11 are received in a first holder 16 while the two adjacent doctor blade bars 12 and 13 are received in a second holder 17. These two holders 16 and 17 are, in turn, secured on a crossbar or crossbeam 18 that is located between the spaced side frames 7 and 8. Each of these holders 16 and 17 has four spaced doctor blade bar locking and placement devices, or doctor blade base shifting devices, generally at 19 and 21 with two such doctor blade base shifting devices 19 and 21 being associated with each separate doctor blade bar 9, 11, 12 and 13.

Figure 5:
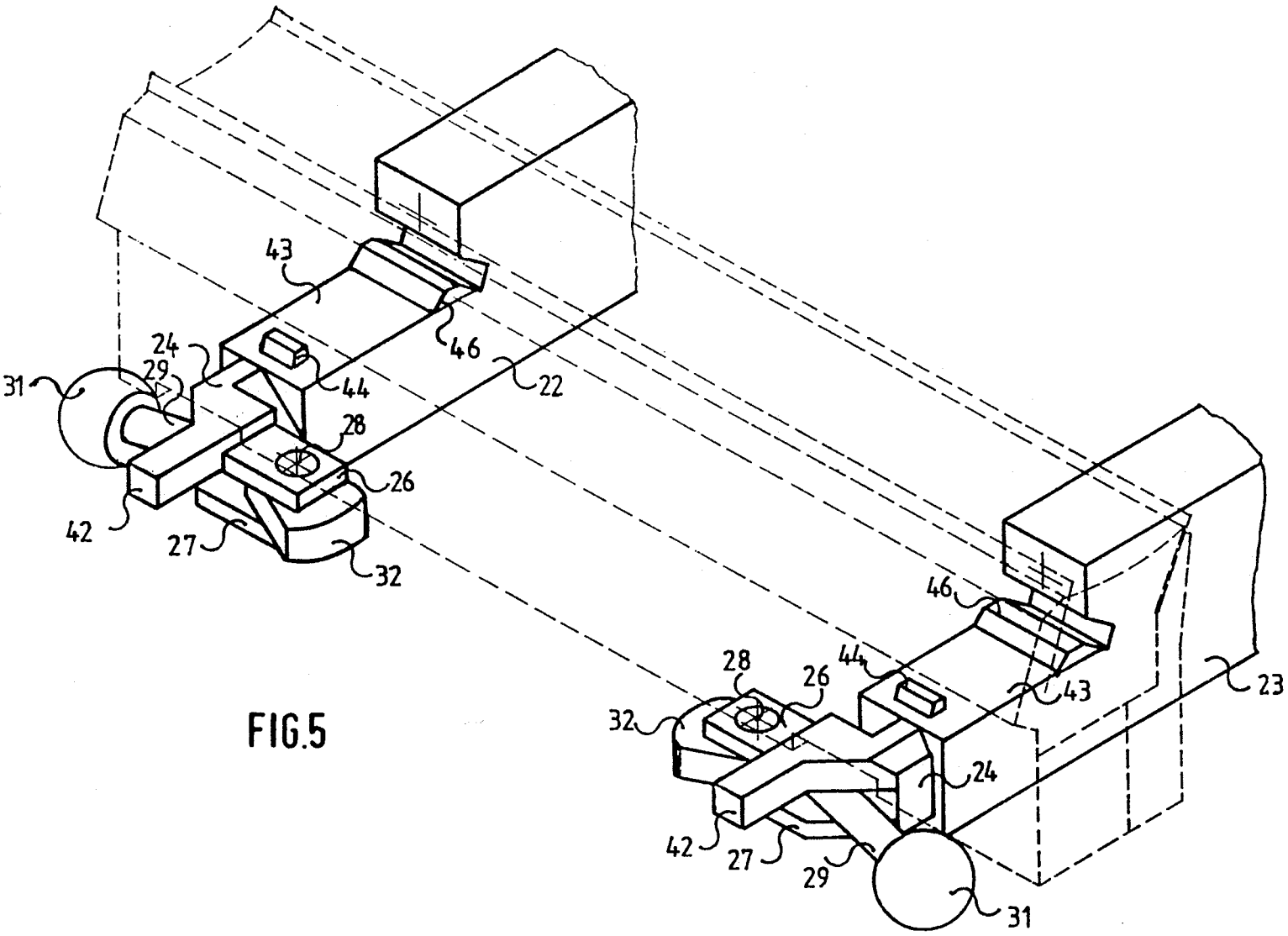
FIG. 5 is a perspective view of a pair of doctor blade base support beams and showing the doctor blade base shifting devices in the mounting position.

Spaced doctor blade base support beams, generally at 22 and 23, as seen in FIGS. 2–6 and most clearly in FIG. 5 are used to support each of the doctor blade bars 9, 11, 12 and 13. While the ink dispensing roller 1 will be discussed subsequently, as a screen roller, it will be understood that it would also be possible to utilize a different ink-dispensing roller in place of the screen roller 1.

Referring now to FIGS. 2–6, it will be seen that each doctor blade bar locking and placement assembly 19 and 21 or doctor blade base shifting assembly 19 or 21 utilizes a somewhat L-shaped shifting body 24 that has a lower end and spaced angled, fork-shaped upper ends 26 and 27. An axially extending shaft 28 extends between these two fork-shaped ends 26 and 27 generally parallel to the axis of rotation of screened ink roller 1. A lever 29 has a ball handle 31 at a first end and an eccentric cam surface 32 is formed on the second end of the lever 29. The lever 29 is rotatably supported by a bore in the eccentric 32 which is carried by the shaft 28. The two doctor blade base shifting assemblies 19 and 21 which are used for the support and positioning of one of the doctor blade bars are shown in FIG. 5. In the rest of FIGS. 2, 3, 4 and 6 only one of the shifting assemblies 19 or 21 is shown. It will be understood that these shifting assemblies 19 and 21 are operable as pairs.

Figure 6:
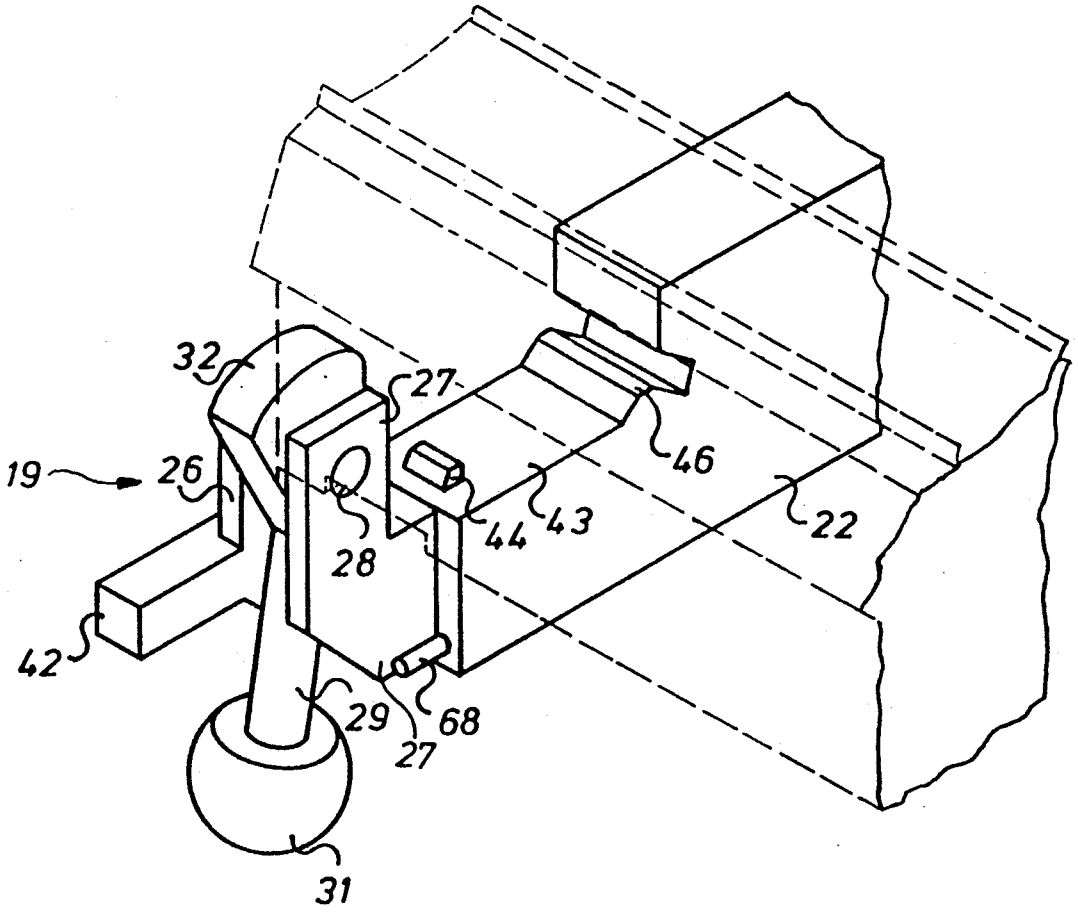
FIG. 6 is a perspective view of a single doctor blade base support beam and showing the doctor blade base shifting device in the rest position.

Turning now primarily to FIGS. 2, 3 and 4, each generally L-shaped shifting body 24 of each of the doctor blade base shifting assemblies 19 and 21 is generally the same. Each body 24 includes a guide rail 42, as seen in FIGS. 5 and 6, which will be discussed in detail subsequently. A first, lower end of the body 24 is provided with a tapped bore hole that receives a threaded end of a set screw or dowel screw 33. This dowel screw 33 is positionable in a bore hole 34 that is formed in a free end of the doctor blade base support beam 23 with the pocket bore hole 34 extending generally parallel to a guide surface 43 of the beam 23. The set screw 33 carries an elongated sleeve 36 whose external outer diameter corresponds to the inside diameter of the pocket borehole 34. The borehole 34 may be threaded and the exterior of the sleeve 36 may also be threaded. The sleeve 36 has a circumferential groove 37 extending completely around it intermediate its ends. A clamping or locking screw 38 is screwed into a threaded bore in the bottom portion of the beam 23 and an inner end of clamping or locking screw 38 is receivable in the groove 37 to hold the sleeve 36 in the pocket bore hole 34. A plurality of cup or plate springs or Belleville washers or the like, generally at 41, are placed between an inner end of sleeve 36 and an enlarged head 39 of the set screw 33. The threaded end of the set screw 33 is passed through the cup springs 41 and the sleeve 36 and is screwed into the threaded bore in the first end of the L-shaped body 24 of the blade base shifting assembly 21. The sleeve 36 is then positioned in the pocket borehole 34 and is held so that it cannot move axially in borehole 34 by the clamp screw 38. It will be noted that the cup springs 41 allow some axial movement of the set screw 33 in the sleeve 36 and that the clamp or locking screw 38 allows the sleeve 36 to turn while in the pocket bore 34.

Each end of each of the four doctor blade bars 9, 11, 12 and 13 is supported for sliding movement by one of the spaced doctor blade base support beams 22 and 23, as shown most clearly in FIG. 5. In FIGS. 2, 3 and 4, only one of these doctor blade base support beams 23 for each doctor blade bar 9, 11, 12 or 13 is shown. However, it will be understood that these support beams 22 and 23 are provided in pairs. Each doctor blade base support beam 22 or 23 is secured at a first end to one of the holders 16 or 17. The beams 22 and 23 extend in cantilever fashion away from the holders 16 or 17 and beneath the screened ink roller 1. The support beams 22 and 23 are generally perpendicular to the axis of rotation of the screened ink roller 1. A sliding cooperation between a pair of doctor blade supporting base body members 47 and 48, which form each doctor blade bar, and each base support beam 18 or 19 is provided. An upper surface of each of the base support beams 22 or 23 is provided with a guide surface 43 upon which the base body members 47 and 48 are slidably supported for movement toward and away from the first end of the blade base support beams 22 and 23. First and second spaced, transverse lifting strips or cam members 44 and 46 are formed on each blade base support beam 22 or 23. Both strips or cam members 44 and 46 have wedge-shaped cross sections, and the same height. However, as may be seen most clearly in FIG. 2, they have different widths, b44 and b46 so that they have different camming or lateral surfaces 72 and 73 with different ascending gradients or slopes s44 and s46. In the preferred embodiment of the apparatus for the clamping and placement of a doctor blade bar against an ink dispensing roller in accordance with the present invention, the ascending gradient or slope of the cam member 44 is greater than the slope of the cam member 46. Thus $s44 > s46$ and $b44 < b46$. This difference in the slopes of the camming surfaces allows the doctor blade bar and its associated doctor blades to follow a somewhat arcuate or curved path during throw-on or throw-off of the doctor blades. This arcuate path to some extend follows the curvature of the screen roller I and reduces the clearance space required between the doctor blades and the screen roller to effect throw-on or throw-off of the blades without scraping them along the surface of the screen roller 1.

Referring again primarily to FIGS. 2, 3 and 4, each doctor blade bar 9, 11, 12 and 13 consists of a two piece base body having the first and second doctor blade supporting base body members 47 and 48. These base body members 47 and 48 of each doctor blade bar 9, 11, 12 and 13 extend parallel to the axis of rotation of the screen roller 1 between their associated spaced doctor blade base support beams 22 and 23. The first doctor blade base body member resiliently supports a working or stripping-off doctor blade 52 in a first doctor blade holder 49. The second doctor blade base body member 48 supports a closing or sealing doctor blade 53 in a doctor blade holder 51. Closing or end plates 54 are disposed at the axial ends of the two doctor blades 52 and 53 and cooperate with them to form the ink chamber of the doctor blade. This ink chamber has an open upper portion so that the screen roller 1 can have its surface in contact with the reservoir of ink in the ink chamber of the doctor blade. As the screen roller moves in the direction indicated by arrow D in FIGS. 2, 3, and 4, the ink in the reservoir will be applied to the screen roller 1. The working or stripping-off blade 52 and the sealing or closing blade 53 contact the surface of the screen roller 1 at a negative angle a as measured with respect to the line 56 which is perpendicular to the tangent line T drawn at the point of contact of the working blade 52 with the screen roller 1, as seen in the working position shown in FIG. 4.

Again referring primarily to FIGS. 2, 3 and 4, each of the base body members 47 and 48 has a pair of spaced counter strips or cam followers 50 and 55, with leading edges 57 and 58. These counter strips or cam followers 50 and 55 slide along the upper surface 43 of the two spaced doctor blade base support beams 22 and 23 upon actuation of the eccentrics 32 and cause the doctor blade support base body members 47 and 48 move in the direction indicated by arrow C in FIG. 2. The leading edges 57 and 58 of the counter strips 50 and 55 ride up the cam surfaces 72 and 73 of the lifting strips 44 and 46 as each doctor blade bar 9, 11, 12 or 13 is moved between the rest position shown in FIG. 3 and the work position shown in FIG. 4. In this work position, an inner or rear surface 76 of the second base body member 48 engages a vertical abutment face of the support beams 22 and 23.

As may be seen in FIGS. 2, 3 and 4, the second base body member 48 has an indexing indentation on its surface closest to the bar 16 or 17. This indexing indentation is in the form of a pocket or blind hole 59 that has a chamfered lower surface 61. This chamfered lower surface 61 slopes downwardly toward the upper end of an edge 58 on the base body member 48. Referring again to Figs. 2, 3 and 4, a borehole is formed in each of the doctor blade base support beams 22 and 23 with this borehole being generally parallel to the pocket borehole 32 and extending from the first end of each of the beams 22 and 23 to a point adjacent the pocket hole 59 in the base body member 48. A pressure piece 63 is supported in this borehole and extends out from the beam toward the base body member 48. A spring 62 is utilized in the borehole to bias the pressure piece 63 out of the beam. As may be seen in FIG. 4, when the blade base shifting assembly 21 is used to move the base body members 47 and 48 to the right to thereby engage the free ends of the doctor blades 52 and 53, respectively, with the surface of the screened ink roller 1, the pressure piece 63 will be forced into its borehole by the chamfered edge 61 of the pocket hole 59 in the base body member 48 and will engage a suitable limit switch 64. The limit switch 64, in turn engages a contact piece 66 which is connected through suitable wires or cables 67 with the ink pump that will supply ink to the ink chamber defined by the doctor blades 52 and 53 and the end or closing plates 54. Thus when the doctor blade bar assembly is in the position shown in FIG. 4, the depression of the contact piece 63 will cause ink to be delivered to the ink chamber. When the doctor blade bar assembly is in the thrown-off position shown in FIG. 3, the ink pump will be deactivated and no ink will be supplied to the ink chamber.

When it is necessary to move the doctor blade base body members 47 and 48 and hence their associated doctor blades 52 and 53, respectively from their work position shown in FIG. 4 to their thrown-off or rest position shown in FIG. 3, the ball handles 31 of the levers 29 will be grasped and the lever pulled downwardly to the position shown in FIG. 3. This will rotate the cam body or eccentric 32 with the shaft 28. Such rotation of the cam body will cause the eccentric cam surface 32 to disengage an outer face 74 of the base body member 47 and to thus lose its locking effect against the force of the springs 41. This causes the base body member 47 and its associated base body member 48 to move to the left along support surface 43. Since the eccentric 32 is no longer in contact with the face 74 of the base body member 47, the doctor blade bar will be in its rest position, as shown in FIG. 3. In this position, the springs or washers 41 will cause a space "" all to be formed between the doctor blade bar base support beam 23 and the doctor blade base body 48 wherein the edge portions 57 and 58 of the cam followers move out of engagement with the lifting strips or cams 44 and 46 and are again supported on the surfaces 43 of the doctor blade base support beams 22 and 23. In this position, as seen in FIG. 3, the pressure piece 63 is not in contact with the switching depression 59 so that the limit switch 64 will have turned off the ink supply.

If the doctor blade bar is to be brought from its rest position into a mounting position, as shown in FIG. 5, for example, for removal of the doctor blades 52 and 53 to change or clean them, the L-shaped bodies 24 of the base shifting assemblies 19 and 21 can be rotated through 90° by pushing laterally on the ball handle 31 of the lever 29 since the bodies 24 will rotate with sleeves 36 turning in the pocket boreholes 34. The L-shaped bodies 24, once they have been rotated 90°, as is shown in FIGS. 2 and 5, will form a horizontal plane that includes guide rails 42 and is a continuation of the guide surfaces 43 of the doctor blade base support beams 22 and 23. The doctor blade base body members 47 and 48 can be slid out along this horizontal plane, as shown in FIG. 2. The doctor blade bar 13 can be moved out on the two guide rails 42 which are shown in FIG. 5 until the end or face 74 of the first blade base support bodies 47 rests against the ball handles 31. Thus only a small space is needed to manipulate the doctor blade bars 9, 11, 12 and 13. This operation can be reversed to move the doctor blade bars from their mount or rest positions back to their work positions.

In the work position of the doctor blade bar 9 depicted in FIG. 4, the spacing or distance "e" is the value of the pre-stressing of the plate springs or washers 41 with which the doctor blade bars 9, 11, 12 and 13 are clamped.

As may be seen in FIG. 6, a stop 68 is provided on the lower outer portion of the free end of the doctor blade base support beam 22. A similar stop is provided on the second doctor blade base support beam 23 for each of the doctor blade bars 9, 11, 12 and 13. These stops are used to limit the rotation of the generally L-shaped bodies 24 of the doctor blade base shifting devices 19 and 21 so that they cannot rotate more than 90° into the positions shown in FIG. 5. Further rotation of bodies 24 would disturb the horizontal support surfaces depicted in FIG. 5.

It will be understood that other devices could be used instead of the eccentrics 32 and plate springs 41 to effect clamping of the doctor blade bars. For example, pneumatic work cylinders could be utilized.

It is also possible, in accordance with the present invention to provide the same ascending gradients S44 and S46 for the two lifting strips 44 and 46. The distance "f" between the leading edges 57 and 58 of the counter strips or cam followers 50 and 55, as seen in FIG. 3 is then greater than the distance "g" between the lifting strips 44 and 46. As shown in FIG. 4, the upper surfaces 69 and 70 of the lifting strips 44 and 46 are in functional and operative contact with the horizontal flat surfaces of the counter strips 50 and 55.

As may be seen most specifically in FIGS. 2 and 4 the working or stripping off blade 52 is biased outwardly in its blade holder 49 toward the screen roller by a spring 71. The resilient support of this working blade 52 is important during the operation of placing the doctor blade bar and its associated doctor blades in operative contact against the screen roller 1. Since the working blade 51 follows a somewhat curved path, generally as indicated by arrow C in FIG. 2 due to the different ascending gradients S44 and S46 of the lifting strips 44 and 46, the use of the biasing spring 71 allows the blade to contact the surface of the screen roller 1 without being bent or otherwise damaged. The spring 71 also continually urges the working or stripping blade 52 toward the screen roller I to compensate for wear of the blade.

While a preferred embodiment of an apparatus for the clamping and placement of a doctor blade bar against an ink-dispensing roller in accordance with the present invention has been set forth fully and completely hereinabove, it will be apparent to one of skill in the art that a number of changes in, for example the overall size of the screen roller, the number of doctor blade bars used with the screen roller, the type of ink used and the like could be made without departing from the true spirit and scope of the present invention which is accordingly to be limited only by the following claims.

What is claimed is:

1. An apparatus for the clamping and placement of a doctor blade bar against an ink dispensing roller in a web fed rotary printing press, said apparatus comprising:

a doctor blade bar;

first and second spaced doctor blade bar support beams, said first and second spaced doctor blade bar support beams each supporting said doctor blade bar for sliding movement thereon;

means engaging said doctor blade bar to shift said doctor blade bar on said first and second doctor blade base support beams to move said doctor blade bar with respect to an ink dispensing roller, said doctor blade bar shifting means including a shifting body rotatably secured at a first end to a first end of each of said support beams, and having spaced arms at a second end, said spaced arms rotatably supporting a shaft having a double armed lever with a stop on a first end and an eccentric on a second end, said eccentric being engageable with a front face of said doctor blade bar;

a pressure piece and switch assembly supported by one of said first and second doctor blade bar support beams and being engageable with a rear face of said doctor blade bar; and an abutment face on each of said support beams, said doctor blade bar engaging said abutment face when said doctor blade bar is positioned in a work position with respect to an ink dispensing roller.

2. The apparatus of claim 1 wherein said shifting body is rotatably secured to each of said support beams by a dowel screw disposed in each of said support beams, said dowel screw having a threaded end in engagement with said first end of said shifting body.

3. The apparatus of claim 2 wherein said dowel screw has an encircling sleeve and further wherein said sleeve is received in a blind bore in each of said support beams.

4. The apparatus of claim 3 wherein said sleeve has an annular groove on its circumference and further wherein a locking screw is positioned in each of said support beams in engagement with said annular groove.

5. The apparatus of claim 3 further including plate springs disposed between a head of said dowel screw and an adjacent end face of said sleeve.

6. The apparatus of claim 1 wherein said lever is secured to said shaft through said eccentric.

7. The apparatus of claim 1 wherein said shifting body includes a guide rail.

8. The apparatus of claim 1 wherein said doctor blade bar has first and second spaced counter strips with first and second edges and further wherein said first and second doctor blade bar support beams each have first and second spaced lifting strips, with first and second inclined surfaces, said doctor blade bar being shiftable by said shifting means through sliding contact of said first and second edges of said first and second counter strips along said first and second inclined surfaces of said first and second lifting strips.

9. The apparatus of claim 1 wherein said stop on said first end of said double armed lever is a ball handle.

* * * * *